US007181917B2

(12) United States Patent
Hwang et al.

(10) Patent No.: US 7,181,917 B2
(45) Date of Patent: Feb. 27, 2007

(54) CONTROL METHOD FOR FOUR-WAY VALVE OF MULTIPLE HEAT PUMP

(75) Inventors: Il Nahm Hwang, Ansan-si (KR); Sai Kee Oh, Seoul (KR); Yoon Been Lee, Seoul (KR); Se Dong Chang, Kwangmyung-si (KR)

(73) Assignee: LG Electronics Inc., Seoul (KR)

( * ) Notice: Subject to any disclaimer, the term of this patent is extended or adjusted under 35 U.S.C. 154(b) by 176 days.

(21) Appl. No.: 11/063,581

(22) Filed: Feb. 24, 2005

(65) Prior Publication Data

US 2005/0193748 A1 Sep. 8, 2005

(30) Foreign Application Priority Data

Feb. 25, 2004 (KR) ..... 10-2004-0012583

(51) Int. Cl.
*F25B 1/00* (2006.01)

(52) U.S. Cl. ..... 62/115; 62/160

(58) Field of Classification Search ..... 62/115, 62/159, 160, 161, 238.7, 528, 324.6
See application file for complete search history.

(56) References Cited

U.S. PATENT DOCUMENTS 4,420,947 A * 12/1983 Yoshino ..... 62/160
5,473,906 A * 12/1995 Hara et al. ..... 62/160
5,651,263 A * 7/1997 Nonaka et al. ..... 62/205
5,664,421 A * 9/1997 Matsue et al. ..... 62/6
5,711,163 A * 1/1998 Uchikawa et al. ..... 62/324.6
5,775,126 A * 7/1998 Sato et al. ..... 62/480
5,832,735 A * 11/1998 Matsumoto et al. ..... 62/151
6,244,057 B1 * 6/2001 Yoshida et al. ..... 62/160
6,883,342 B2 * 4/2005 Kato et al. ..... 62/238.7
6,883,345 B2 * 4/2005 Lee ..... 62/324.6
6,945,066 B2 * 9/2005 Hiwata et al. ..... 62/324.6
6,973,796 B2 * 12/2005 Park et al. ..... 62/160
7,013,666 B2 * 3/2006 Park et al. ..... 62/324.6

FOREIGN PATENT DOCUMENTS

JP 10-176843 A * 6/1998

* cited by examiner

*Primary Examiner*—Mohammad M. Ali
(74) *Attorney, Agent, or Firm*—Birch, Stewart, Kolasch & Birch, LLP

(57) ABSTRACT

Disclosed herein is a control method for four-way valves of a multiple heat pump. In the control method, if even at least one of four-way valves of respective outdoor units is not switched to a desired mode upon switching of all of the four-way valves to the desired mode, the other four-way valves, switched to the desired mode, is switched to an opposite direction of the desired mode, and then all of the four-way valves are switched again to the desired mode, thereby simply and rapidly correcting switching error of the four-way valves, resulting in normal operation of the multiple heat pump.

20 Claims, 7 Drawing Sheets

CONTROL METHOD FOR FOUR-WAY VALVE OF MULTIPLE HEAT PUMP

BACKGROUND OF THE INVENTION

1. Field of the Invention

The present invention relates to a control method for a four-way valve of a multiple heat pump, and more particularly, to a control method for a four-way valve of a multiple heat pump which controls operation of four-way valves showing switching error to a cooling or heating mode, thereby ensuring normal operation of the four-way valves.

2. Description of the Related Art

FIG. 1 is a schematic diagram illustrating a refrigeration cycle of outdoor units provided in a conventional multiple heat pump system. Here, the conventional multiple heat pump system includes three outdoor units A, B and C.

Each of the outdoor units A, B and C comprises a compressor 10 that supplies a high-temperature and high-pressure gas refrigerant, a four-way valve 20 that switches refrigerant flow for use in a cooling or heating mode, an outdoor heat exchanger 30 that serves as a condenser to condense the refrigerant when an indoor heat exchanger acts as a cooler and also serves as an evaporator to evaporate the refrigerant when the indoor heat exchanger acts as a heater, and an expander 40 that expands the refrigerant to a low-temperature and low-pressure refrigerant.

When the heat pump system operates in a cooling mode, the gas refrigerant, compressed in the compressor 10, is introduced into a high-pressure portion 21 of the four-way valve 20 after passing through a certain element, such as an oil separator. Then, the gas refrigerant is introduced into the outdoor heat exchanger 30 via a connecting portion 22, thereby being condensed in the outdoor heat exchanger 30. After that, the refrigerant is supplied to an indoor unit by successively passing through the expansion valve 40 and a refrigerant pipe 41.

The gas refrigerant, evaporated while passing through an indoor heat exchanger, is returned to a suction port of the compressor 10 after passing through a connecting portion 23 and a low-pressure portion 24 of the four-way valve 20 via a refrigerant pipe 45.

On the contrary, when the heat pump system operates in a heating mode, the gas refrigerant, discharged from the compressor 10, successively passes through the high-pressure portion 21 and the connecting portion 23 of the four-way valve 20, and then is supplied into the indoor unit via the refrigerant pipe 45. After being condensed in the indoor heat exchanger, the resulting liquid refrigerant is introduced into the outdoor unit via the refrigerant pipe 41 and is expanded while passing through the expansion valve 40. In succession, the refrigerant is evaporated in the outdoor heat exchanger 30, and is introduced into the suction port of the compressor 10 by successively passing through the connecting portion 22 and the low-pressure portion 24 of the four-way valve 20.

In the multiple heat pump air conditioning system having two or more heat pump systems operating as stated above, the four-way valves 20 of the respective outdoor units are controlled to keep the same refrigerant channel switching manner as one another in the cooling or heating mode.

That is, in the cooling mode, all of the four-way valves 20 are switched to keep a cooling position as shown in FIG. 1, while, in the heating mode, all of the four-way valves 20 are switched to keep a heating position in an opposite direction of FIG. 1.

Especially, in order to switch the four-way valves 20, kept at the cooling position, to the heating mode, at least one of the compressors 10 of the respective outdoor units has to be driven to generate high and low pressures at the associated outdoor unit, so that the four-way valves 20 of the respective outdoor units are able to be switched using a pressure difference.

Switching manners of the four-way valves 20 are basically classified into two manners. A first switching manner is a low-pressure connection manner that connects the low-pressure portion 24 to both pressure-transmission holes 25 and 26 located at opposite sides of the low-pressure portion 24. If the low-pressure portion 24 is connected to one of the pressure-transmission holes 25 and 26, i.e. left pressure-transmission hole 25, a slider, disposed in each of the four-way valves, moves leftward to the heating position. Conversely, if the low-pressure portion 24 is connected to the other one, i.e. right pressure-transmission hole 26, the slider moves rightward to the cooling position as shown in FIG. 1.

Movement of the slider of the four-way valve 20 as stated above requires a minimum operating differential pressure. The operating differential pressure is produced upon driving of the compressor 20.

A second switching manner is a high/low pressure connecting manner that connects the high-pressure portion 21 to the left pressure-transmission hole 25 and the low-pressure portion 24 to the right pressure-transmission hole 26. The second switching manner is effective to readily move the slider of the four-way valve 20 as compared to the first switching manner since it produces high and low pressures at opposite sides.

Therefore, in order to switch the four-way valves 20 of the respective outdoor units A, B and C, after driving the compressors 10, the sliders, disposed in the respective four-way valves 20, move to the cooling or heating position when a predetermined operating differential pressure is produced, completing switching of the four-way valves 20 to the cooling or heating position.

Here, instead of simultaneously completing switching of the three four-way valves 20, as shown in FIG. 2, two four-way valves may be switched to the heating position, but the remaining four-way valve may not be completely switched from the cooling position to the heating position. In this case, since high-pressure producing portions 23H, connected to the high-pressure portions 21 of the outdoor units B and C, are connected to a low-pressure producing portion 23L of the outdoor unit A via a refrigerant pipe 45*a*, the low-pressure producing portion 23L of the outdoor unit A undergoes a pressure rising to thereby reach the same state as a high-pressure producing portion 22H of the outdoor unit A.

On the contrary, the high-pressure producing portion 22H of the outdoor unit A is connected to the outdoor units B and C via a high/low pressure connecting pipe 50, causing the refrigerant to flow to the low-pressure producing portions 22L that serve as connecting portions.

Continuation of such a state makes it impossible to switch the four-way valve 20 of the outdoor unit A using the conventional four-way valve switching manners when the outdoor unit A malfunctions.

Therefore, when the four-way valve 20 of one of the outdoor units provided in the multiple heat pump falls into a switching error, this makes it impossible normal cooling/heating operations of the multiple heat pump, and may cause damage to the multiple heat pump when the heat pump is continuously operated in the switching error state. Especially, such a malfunction problem of the outdoor unit cannot be solved by simply repeatedly operating the multiple heat pump.

SUMMARY OF THE INVENTION

Therefore, the present invention has been made in view of the above problems, and it is an object of the present invention to provide a control method for four-way valves of a multiple heat pump which controls operation of at least one of four-way valves of respective outdoor units showing switching error so as to enable normal operation of the four-way valves, thereby ensuring simple and rapid normal operation of the multiple heat pump.

In accordance with the present invention, the above and other objects can be accomplished by the provision of a control method for four-way valves of a multiple heat pump comprising: determining whether or not all of the four-way valves of respective outdoor units are normally switched to a desired mode; switching ones of the four-way valves, switched to the desired mode, to an opposite direction of the desired mode if the other one or more four-way valves are not switched to the desired mode, so as to correct switching error; and switching again all of the four-way valves to the desired mode, after completing the switching error correction.

Preferably, the determination of switching state of the respective four-way valves may be achieved by using a first predetermined differential pressure that is a pressure difference between high and low pressures at inlet and outlet sides of respective compressors.

Preferably, if even at least one of the outdoor units has the pressure difference smaller than the first predetermined differential pressure after the lapse of a first predetermined time from a time point when the four-way valves are switched to the desired mode, the switching error may be determined.

Preferably, if the pressure difference of all of the outdoor units is larger than the first predetermined differential pressure after the lapse of a first predetermined time from a time point when the four-way valves are switched to the desired mode, normal switching of the four-way valves may be determined.

Preferably, if the pressure difference of the respective outdoor units is larger than the first predetermined differential pressure after the lapse of a first predetermined time from a time point when the four-way valves are switched to the desired mode and the pressure difference of the respective outdoor units is larger than a second predetermined differential pressure, i.e. a switching operation differential pressure of the four-way valves after the lapse of a second predetermined time, normal switching may be determined.

Preferably, if the pressure difference of the respective outdoor units is larger than a second predetermined differential pressure, i.e. a switching operation differential pressure of the four-way valves after completing the switching error correction, the four-way valves may prepare switching again.

Preferably, if the pressure difference of the respective outdoor units is larger than a second predetermined differential pressure, i.e. a switching operation differential pressure of the four-way valves before the lapse of a second predetermined time after completing the switching error correction, the four-way valves may prepare switching again.

Preferably, after completing the switching error correction, if the pressure difference of the respective outdoor units is not larger than a second predetermined differential pressure, i.e. a switching operation differential pressure of the four-way valves after the lapse of a second predetermined time, switching error of the four-way valves may be determined.

Preferably, the multiple heat pump is of the type that high and low pressure sides of the respective outdoor units may be connected to one another via a high/low pressure connecting pipe.

With such a control method for four-way valves of a multiple heat pump according to the present invention, if even at least one of four-way valves of the respective outdoor units is not switched to a desired mode upon switching of all of the four-way valves to the desired mode, the other four-way valves, switched to the desired mode, is switched to an opposite direction of the desired mode, and then all of the four-way valves are switched again to the desired mode, thereby enabling normal operation of the multiple heat pump with a simple and rapid manner.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of a control method for four-way valves of a multiple heat pump according to the present invention will be described in detail with reference to the annexed drawings.

Figure 3:
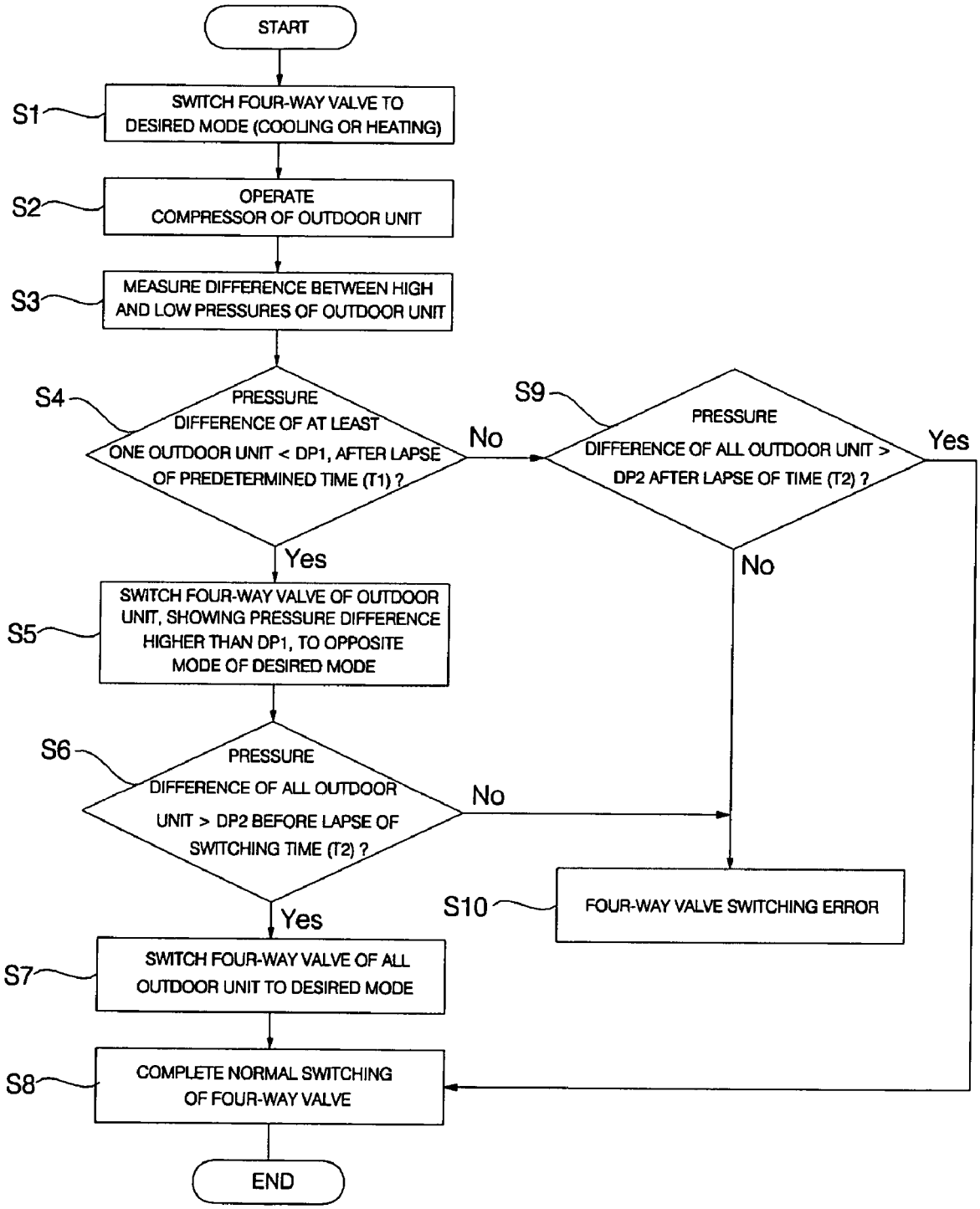
FIG. 3 is a flow chart illustrating a control method for four-way valves of a multiple heat pump according to the present invention.

FIG. 3 is a flow chart illustrating a control method for four-way valves of a multiple heat pump according to the present invention.

As shown in FIG. 3, the control method for four-way valves of a multiple heat pump according to the present invention basically comprises: switching four-way valves of respective outdoor units to a desired mode (S1) and measuring a difference between high and low pressures of each of the outdoor units (S3) when compressors of the respective outdoor units start to operate (S2), thereby determining whether or not all of the four-way valves are normally switched to the desired mode (S4); switching the four-way valves, switched to the desired mode, to an opposite direction of the desired mode (S5) if even at least one of the four-way valves is not switched to the desired mode in Step (S4), so as to correct switching error; switching all of the four-way valves to the desired mode (S7) if a pressure difference of the respective outdoor units becomes larger than a predetermined differential pressure DP2, that is a switching operation differential pressure of the four-way valves, before the lapse of a predetermined time T2, after correcting the switching error; and completing normal switching of the four-way valves (S8).

In the control method for the four-way valves of the multiple heat pump according to the present invention, the determination of switching state of the respective four-way valves is achieved by using a difference between high and low pressures at inlet and outlet sides of each of the compressors, i.e. a predetermined differential pressure DP1. If the pressure difference of at least one of the outdoor units is smaller than the predetermined differential pressure DP1 after the lapse of a predetermined time $T_1$ from a time point when the four-way valves are switched to the desired mode, switching error is determined.

On the contrary, if the pressure difference of the respective outdoor units is larger than the predetermined differential pressure DP1 after the lapse of the predetermined time $T_1$ from a time point when the four-way valves are switched to the desired mode, or if the pressure difference of the respective outdoor units is larger than the predetermined differential pressure DP2, i.e. the switching operation differential pressure of the four-way valves, after the lapse of the predetermined time $T_2$ (S9), normal switching is determined.

In succession, if the pressure difference of the respective outdoor units is larger than the predetermined differential pressure DP2, i.e. the switching operation differential pressure of the four-way valves before the lapse of the predetermined time $T_2$ after completing correction of the switching error, the four-way valves are allowed to advance a next switching step. On the contrary, if the pressure difference of the respective outdoor units is not larger than the predetermined differential pressure DP2, i.e. the switching operation differential pressure of the four-way valves after the lapse of the predetermined time $T_2$ after completing correction of the switching error, switching error of the four-way valves is determined (S10).

Figure 1:
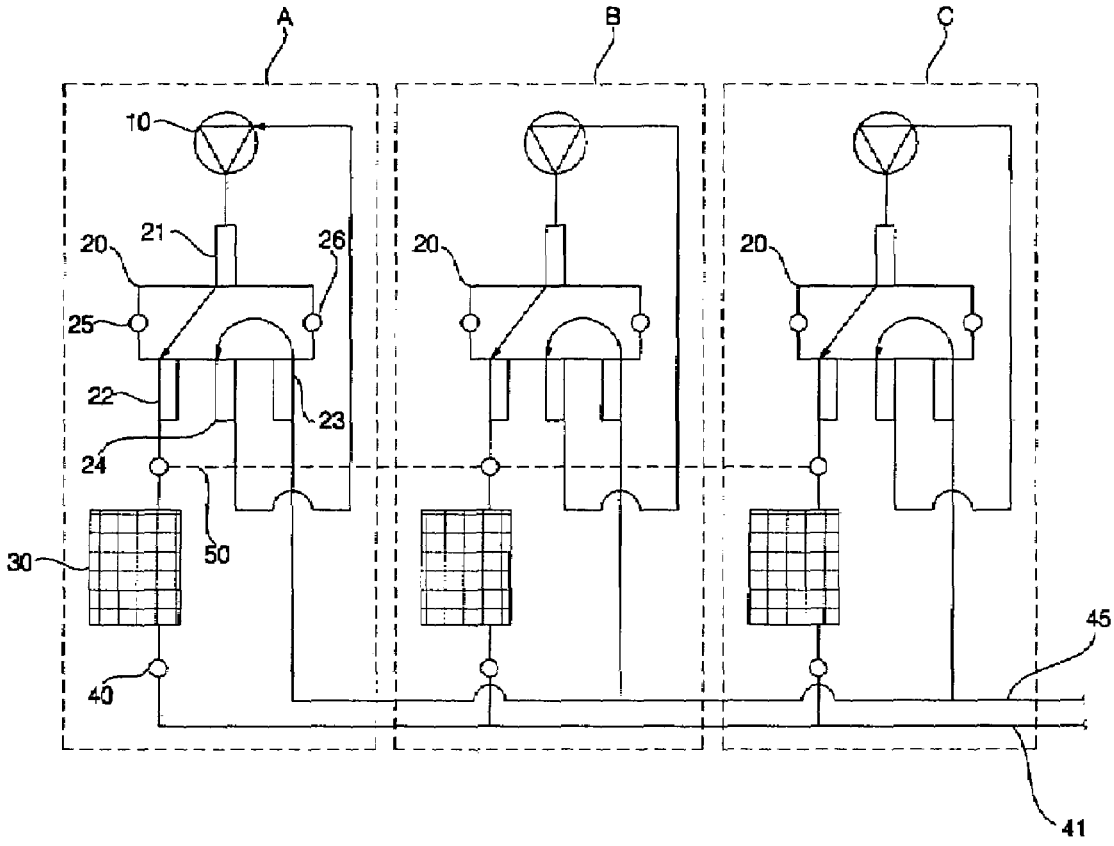
FIG. 1 is a schematic diagram illustrating a refrigeration cycle of outdoor units provided in a conventional multiple heat pump.
Figure 2:
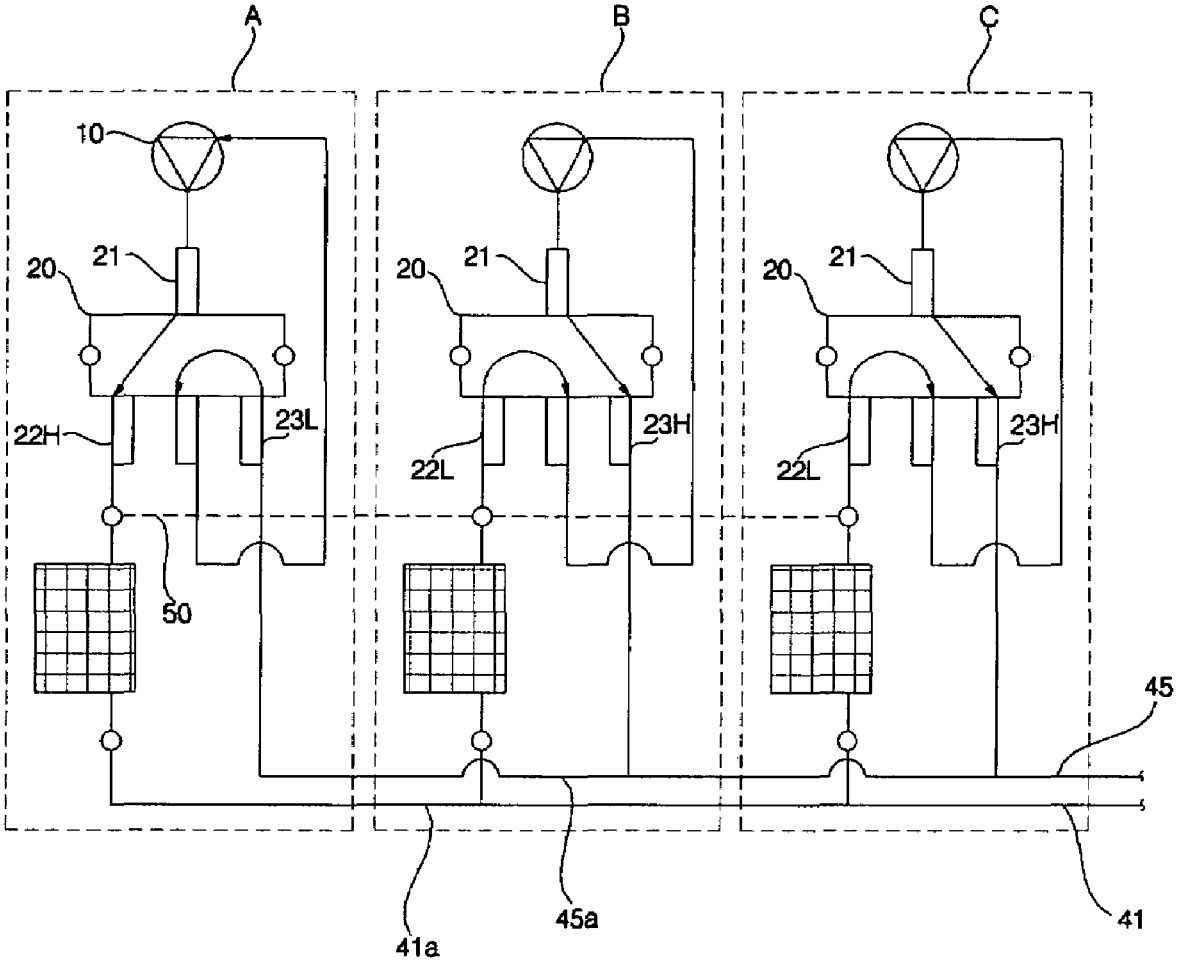
FIG. 2 is a schematic diagram of the refrigeration cycle shown in FIG. 1, illustrating a four-way valve switching error state.

The control method for the four-way valves of the multiple heat pump according to the present invention, as shown in FIG. 1, is applicable to a multiple heat pump of the type wherein the high/low pressure connecting pipe 50 is connected to high and low pressure sides of the respective outdoor units.

Now, the operational effects of the control method for the four-way valves of the multiple heat pump according to the present invention will be explained.

Figure 4:
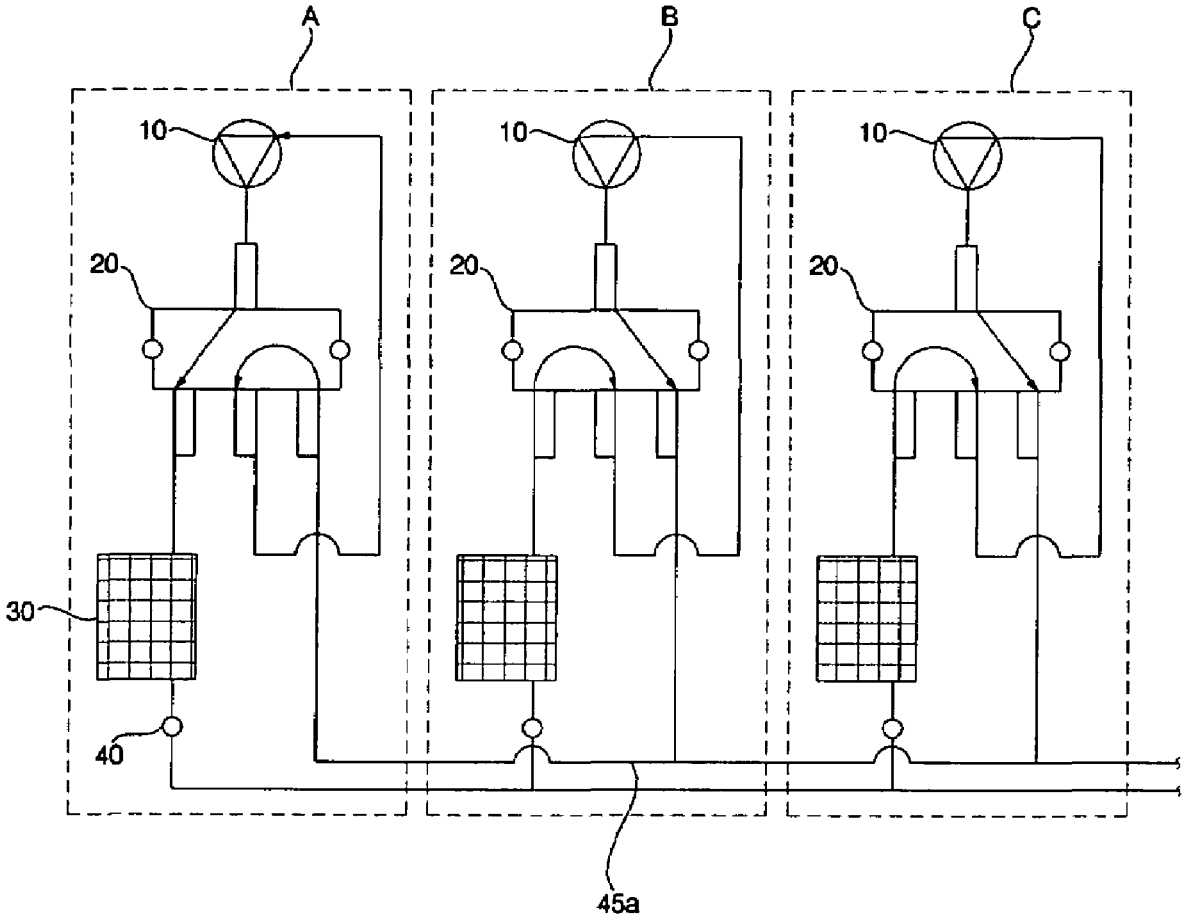
FIG. 4 is a schematic diagram illustrating a four-way valve switching error state upon switching from a cooling mode to a heating mode of the multiple heat pump according to the present invention.
Figure 5:
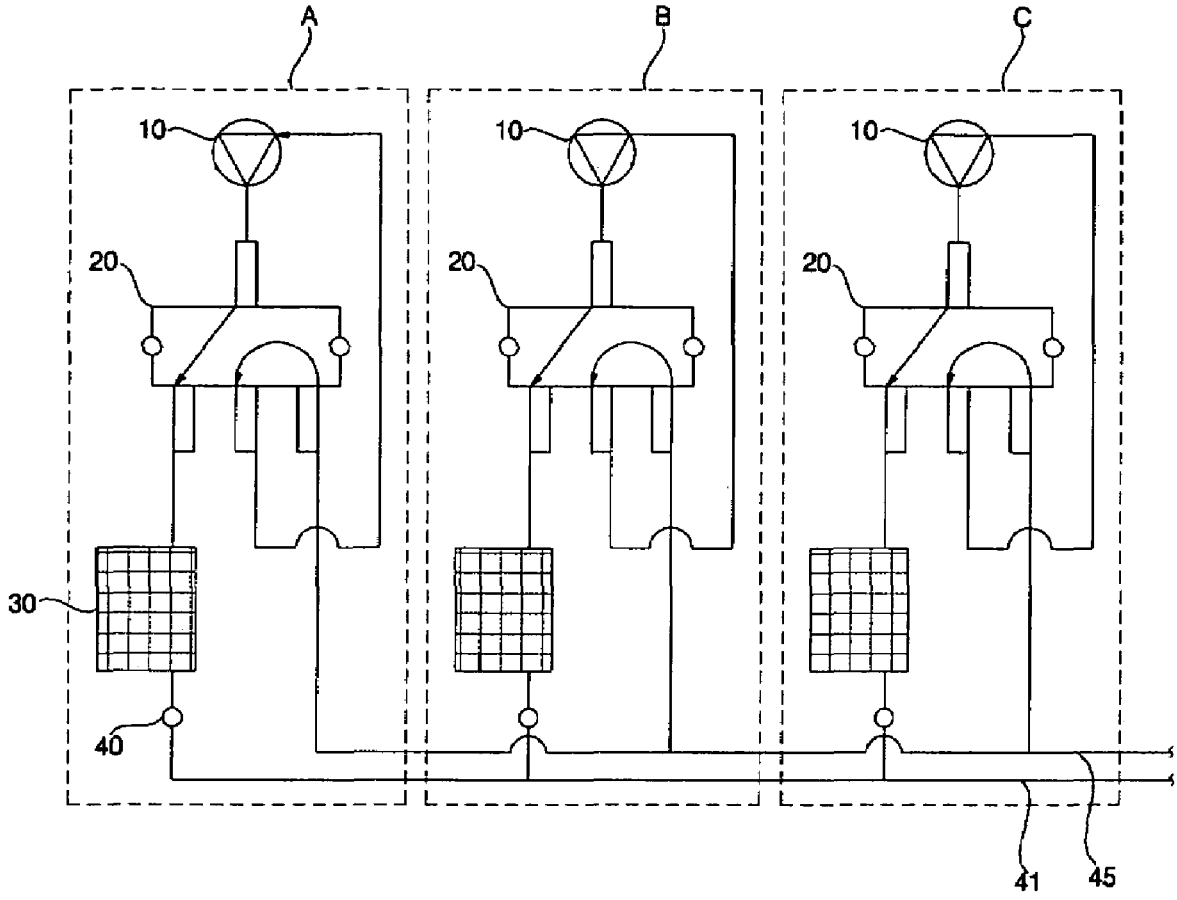
FIG. 5 is a schematic diagram illustrating a four-way valve control structure for correcting the switching error as shown in FIG. 4.

FIG. 4 is a schematic diagram illustrating a four-way valve switching error state upon switching from a cooling mode to a heating mode of the multiple heat pump according to the present invention. FIG. 5 is a schematic diagram illustrating a four-way valve control structure for correcting the switching error as shown in FIG. 4.

Upon switching from a cooling mode to a heating mode of the multiple heat pump, the compressors 10 of the outdoor units A, B and C are first driven and then the four-way valves 20 are switched to the desired heating mode. Here, it is also allowable that the four-way valves 20 are first switched to the desired heating mode and then the compressors 10 are driven.

After completing switching to the desired mode, if a difference between high and low pressures of the respective outdoor units A, B and C, i.e. a pressure difference between inlet and outlet sides of the respective compressors, is smaller than the predetermined differential pressure DP1, switching failure of the four-way valves 20 is determined. Here, the determination of the difference between the high and low pressures of the respective outdoor units is achieved by using input signals sensed by pressure sensors provided at the outlet and inlet sides of the respective compressors 10. Although the predetermined differential pressure DP1 as a determination standard pressure varies from one system to the other system, it conventionally has a value below 300 kPa.

That is, as shown in FIG. 4, when the four-way valve of one of the outdoor units A is switched in an opposite mode of the desired heating mode, the outlet sides of the compressors 10 of the other outdoor units B and C communicate with the inlet side of the compressor 10 of the outdoor unit A, switched to the cooling mode, via the refrigerant pipe 45*a*. This hinders generation of a pressure difference in the outdoor unit A that the four-way valve 20 thereof is switched to the opposite mode of the desired mode, causing the pressure difference of the outdoor unit A to be smaller than the predetermined differential pressure DP1. In this case, switching failure of the four-way valve 10 of the outdoor unit A is determined.

Meanwhile, since the other outdoor units B and C undergo a pressure difference differently from the outdoor unit A having no pressure difference, the four-way valves 20 of the outdoor units B and C are switched to the desired mode using the pressure difference. For the correction of the switching error of the four-way valve 20 of the outdoor unit A, successively, the four-way valves 20 of the outdoor units B and C, having the pressure difference larger than the predetermined differential pressure DP1, are switched to an opposite mode of the desired mode. Thereby, as shown in FIG. 5, the four-way valves 20 of all of the outdoor units A, B and C are aligned in the same direction, i.e. in a cooling mode opposite to the desired heating mode.

If the predetermined time $T_2$ is passed after the four-way valves 20 are switched to an opposite direction of the desired mode, the pressure difference between the high and low pressures of the respective outdoor units A, B and C are measured, so that it is determined whether or not the pressure difference of the outdoor units are larger than the switching operation differential pressure DP2 of the respective four-way valves. Here, the switching operation differential pressure DP2 is a manufacture SPEC value of the four-way valves.

After that, if the pressure difference is larger than the switching operation differential pressure DP2 of the four-way valves, this permits switching of the respective four-way valves 20, allowing the four-way valves 20 to be switched to the desired heating mode. In this way, the switching of the four-way valves to the desired mode is normally completed.

Figure 6:
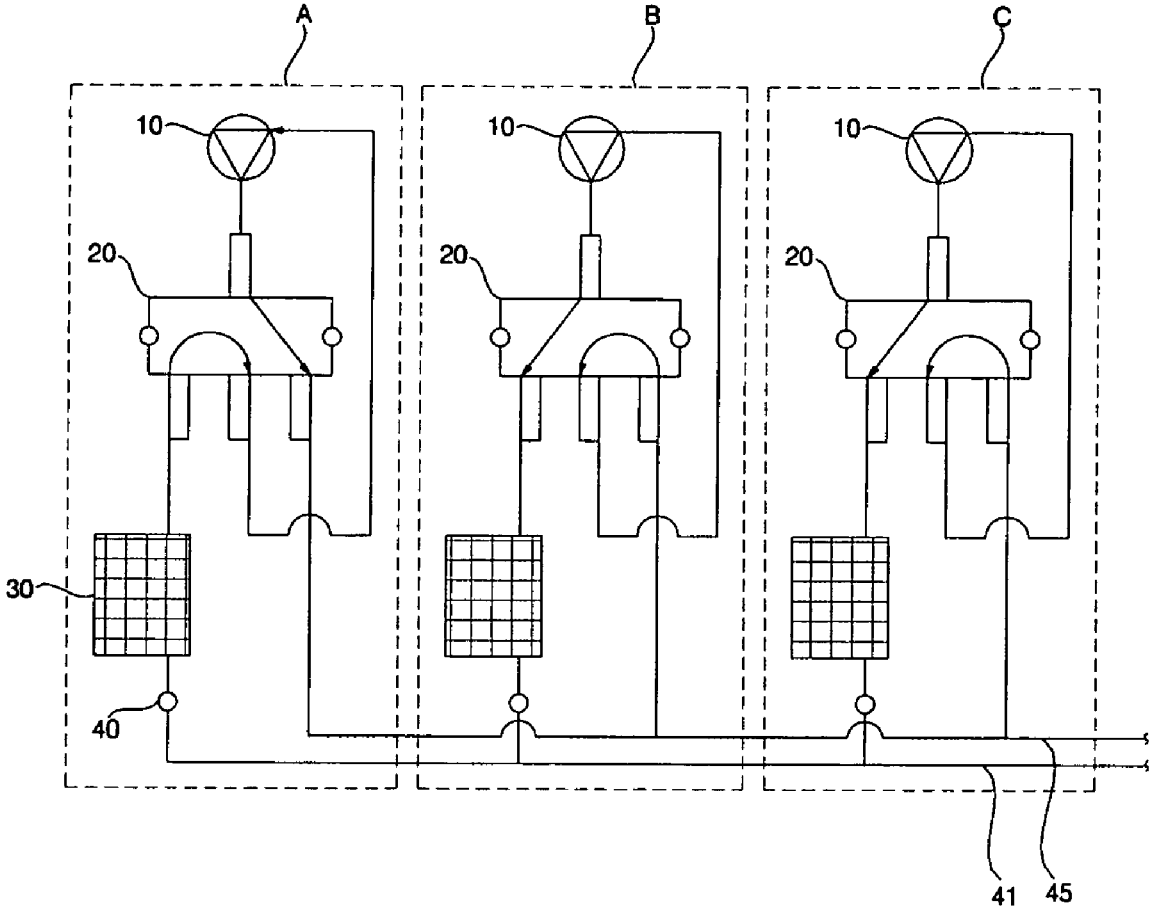
FIG. 6 is a schematic diagram illustrating a four-way valve switching error state upon switching from a heating mode to a cooling mode of the multiple heat pump according to the present invention.
Figure 7:
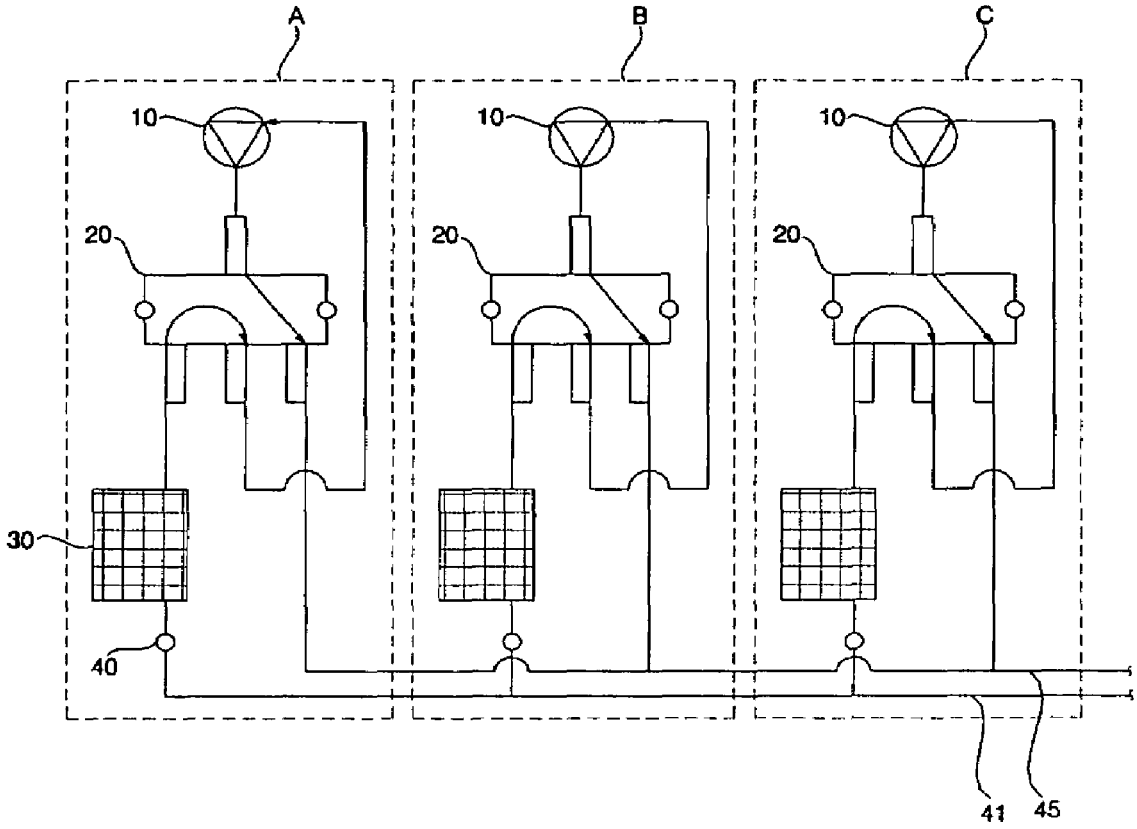
FIG. 7 is a schematic diagram illustrating a four-way valve control structure for correcting the switching error as shown in FIG. 6.

FIG. 6 is a schematic diagram illustrating a switching error state of the four-way valves upon switching from a heating mode to a cooling mode of the multiple heat pump according to the present invention. FIG. 7 is a schematic diagram illustrating a four-way valve control structure for correcting the switching error as shown in FIG. 6.

Even when being switched from a heating mode to a cooling mode, correction of switching error is performed in the same manner as the above described manner.

That is, upon switching from a heating mode to a cooling mode, as shown in FIG. 6, if the pressure difference between the high and low pressures of the respective outdoor units A, B and C is smaller than the predetermined differential pressure DP1 after the lapse of the predetermined time $T_1$, switching failure of the four-way valves 20 is determined. After that, as shown in FIG. 7, the four-way valves 20 of all of the outdoor units A, B and C are aligned in the same direction, i.e. in a heating mode opposite to the desired cooling mode.

After the predetermined time $T_2$ is passed after the four-way valves 20 are switched to an opposite direction of the desired mode, the pressure difference of the respective outdoor units A, B and C is measured again, so that it is determined whether or not the pressure difference is larger than the switching operation differential pressure DP2 of the respective four-way valves 20. If the pressure difference is larger than the switching operation differential pressure DP2, the four-way valves 20 are switched to the desired cooling mode, completing normal switching thereof to the desired mode.

As apparent from the above description, according to a control method for four-way valves of a multiple heat pump of the present invention, if even at least one of four-way valves of respective outdoor units is not switched to a desired mode upon switching of all of the four-way valves to the desired mode, the other four-way valves, switched to the desired mode, is switched to an opposite direction of the desired mode, and then all of the four-way valves are switched again to the desired mode, thereby enabling normal operation of the multiple heat pump with a simple and rapid manner.

Although the preferred embodiment of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A control method for four-way valves of a multiple heat pump comprising:

determining whether or not all of the four-way valves of respective outdoor units are normally switched to a desired mode;

switching ones of the four-way valves, switched to the desired mode, to an opposite direction of the desired mode if the other one or more four-way valves are not switched to the desired mode, so as to correct switching error; and switching again all of the four-way valves to the desired mode, after completing the switching error correction.

2. The method as set forth in claim 1, wherein the determination of switching state of the respective four-way valves is achieved by using a first predetermined differential pressure that is a pressure difference between high and low pressures at inlet and outlet sides of respective compressors.

3. The method as set forth in claim 2, wherein, if even at least one of the outdoor units has the pressure difference smaller than the first predetermined differential pressure after the lapse of a first predetermined time from a time point when the four-way-valves are switched to the desired mode, the switching error is determined.

4. The method as set forth in claim 2, wherein, if the pressure difference of all of the outdoor units is larger than the first predetermined differential pressure after the lapse of a first predetermined time from a time point when the four-way valves are switched to the desired mode, normal switching of the four-way valves is determined.

5. The method as set forth in claim 2, wherein, if the pressure difference of the respective outdoor units is larger than the first predetermined differential pressure after the lapse of a first predetermined time from a time point when the four-way valves are switched to the desired mode and the pressure difference of the respective outdoor units is larger than a second predetermined differential pressure, i.e. a switching operation differential pressure of the four-way valves after the lapse of a second predetermined time, normal switching is determined.

6. The method as set forth in claim 2, wherein, if the pressure difference of the respective outdoor units is larger than a second predetermined differential pressure, i.e. a switching operation differential pressure of the four-way valves after completing the switching error correction, the four-way valves prepare switching again.

7. The method as set forth in claim 2, wherein, if the pressure difference of the respective outdoor units is larger than a second predetermined differential pressure, i.e. a switching operation differential pressure of the four-way valves before the lapse of a second predetermined time after completing the switching error correction, the four-way valves prepare switching again.

8. The method as set forth in claim 2, wherein, after completing the switching error correction, if the pressure difference of the respective outdoor units is not larger than a second predetermined differential pressure, i.e. a switching operation differential pressure of the four-way valves after the lapse of a second predetermined time, switching error of the four-way valves is determined.

9. The method as set forth in claim 1, wherein, if a pressure difference of the respective outdoor units is larger than a second predetermined differential pressure, i.e. a switching operation differential pressure of the four-way valves after completing the switching error correction, the four-way valves prepare switching again.

10. The method as set forth in claim 1, wherein, if a pressure difference of the respective outdoor units is larger than a second predetermined differential pressure, i.e. a switching operation differential pressure of the four-way valves before the lapse of a second predetermined time after completing the switching error correction, the four-way valves prepare switching again.

11. The method as set forth in claim 1, wherein, after completing the switching error correction, if a pressure difference of the respective outdoor units is not larger than a second predetermined differential pressure, i.e. a switching operation differential pressure of the four-way valves after the lapse of a second predetermined time, switching error of the four-way valves is determined.

12. The method as set forth in claim 1, wherein the multiple heat pump is of the type that high and low pressure sides of the respective outdoor units are connected to one another via a high/low pressure connecting pipe.

13. A control method for four-way valves of a multiple heat pump comprising:

switching the four-way valves of respective outdoor units to a desired mode, and then measuring a difference between high and low pressures of a respective one of the outdoor units after the lapse of a first predetermined time, thereby determining whether or not the pressure difference of the respective outdoor units is larger than a first predetermined differential pressure;

switching the four-way valves of ones of the outdoor units, having the pressure difference larger than the first predetermined differential pressure, to an opposite direction of the desired mode, if the remaining outdoor unit has the pressure difference below the first predetermined differential pressure, so as to correct switching error; and switching again the four-way valves of the respective outdoor units to the desired mode if the pressure difference of all of the outdoor units becomes larger than a second predetermined differential pressure, i.e. a switching operation differential pressure of the four-way valves before the lapse of a second predetermined time, after completing the switching error correction.

14. The method as set forth in claim 13, wherein, if the pressure difference of all of the outdoor units is larger than the first predetermined differential pressure after the lapse of the first predetermined time from a time point when the four-way valves are switched to the desired mode, normal switching of the four-way valves is determined.

15. The method as set forth in claim 14, wherein, if the pressure difference of the respective outdoor units is larger than the second predetermined differential pressure, i.e. the switching operation differential pressure of the four-way valves after the lapse of the second predetermined time from a time point when the four-way valves are switched to the desired mode, normal switching is determined.

16. The method as set forth in claim 14, wherein, after completing the switching error correction, if the pressure difference of the respective outdoor units is not larger than the second predetermined differential pressure, i.e. the switching operation differential pressure of the four-way valves after the lapse of the second predetermined time, switching error of the four-way valves is determined.

17. The method as set forth in claim 14, wherein the multiple heat pump is of the type that high and low pressure sides of the respective outdoor units are connected to one another via a high/low pressure connecting pipe.

18. The method as set forth in claim 13, wherein, if the pressure difference of the respective outdoor units is larger than the first predetermined differential pressure after the lapse of the first predetermined time from a time point when the four-way valves are switched to the desired mode, and the pressure difference of the respective outdoor units is larger than the second predetermined differential pressure, i.e. the switching operation differential pressure of the four-way valves after the lapse of the second predetermined time, normal switching is determined.

19. The method as set forth in claim 13, wherein, after completing the switching error correction, if the pressure difference of the respective outdoor units is not larger than the second predetermined differential pressure, i.e. the switching operation differential pressure of the four-way valves after the lapse of the second predetermined time, switching error of the four-way valves is determined.

20. The method as set forth in claim 13, wherein the multiple heat pump is of the type that high and low pressure sides of the respective outdoor units are connected to one another via a high/low pressure connecting pipe.

* * * * *